United States Patent [19]

Nason et al.

[11] Patent Number: 4,686,108

[45] Date of Patent: Aug. 11, 1987

[54] CONDUCTIVE COATINGS FOR WOOD PRODUCTS

[75] Inventors: Dale L. Nason, Louisville, Ky.; Richard L. Gray, Columbus, Ohio

[73] Assignee: Reliance Universal, Inc., Louisville, Ky.

[21] Appl. No.: 756,288

[22] Filed: Jul. 18, 1985

[51] Int. Cl.[4] ..... B05D 1/04

[52] U.S. Cl. ..... 427/27; 427/389.7; 427/393; 427/393.5; 427/408

[58] Field of Search ..... 427/27, 408, 393, 389.7, 427/393.5; 252/500, 511

[56] References Cited

U.S. PATENT DOCUMENTS

| | | | |
|---|---|---|---|
| 3,887,496 | 6/1975 | Cornier et al. | 252/500 |
| 4,011,176 | 3/1977 | Saunders et al. | 252/500 |
| 4,013,804 | 3/1977 | Gruetzman | 252/500 X |
| 4,132,674 | 1/1979 | Hwang | 252/500 |
| 4,222,901 | 9/1980 | Sinkovitz | 252/500 |
| 4,294,739 | 10/1981 | Upson et al. | 252/500 X |
| 4,454,058 | 6/1984 | Savit | 252/500 |
| 4,530,778 | 7/1985 | Nelson et al. | 427/27 X |

*Primary Examiner*—Thurman K. Page

*Attorney, Agent, or Firm*—Donald L. Cox

[57] ABSTRACT

Disclosed herein is a conductive polymeric coating having a charge density of greater than about two which, after being applied to a nonconductive substrate, allows overcoating of that substrate by electrostatic spraying. Exemplary of the conductive polymeric coatings useful herein are those based upon quaternized homopolymers or copolymers of dimethyldiallylamine.

9 Claims, No Drawings

CONDUCTIVE COATINGS FOR WOOD PRODUCTS

BACKGROUND OF INVENTION

1. Field of Invention

This invention relates to conductive coatings for wood products. More particularly this invention relates to coatings which conduct electricity sufficiently to allow the use of electrostatic spraying equipment and the application of electrostatic coatings over ordinarily nonconductive wood, glass and plastic articles.

2. Prior Art

The electrostatic spray coating of wooden, glass or plastic, nonconductive articles has been known for many years. An early method of electrostatic spraying of wooden articles is disclosed in U.S. Pat. No. 3,236,679 issued Feb. 22, 1966. This patent discloses the application of monomeric, ionizable, organic materials to a wooden base so as to render the base conductive. The resulting coated wooden base may then be electrostatically spray coated.

Another patent which discloses a means for permitting electrostatic spraying of otherwise nonconductive wooden products is U.S. Pat. No. 4,360,385 issued Nov. 23, 1982.

Other compounds and processes useful in rendering otherwise nonconductive plastic, glass or wooden articles electrostatically coatable include U.S. Pat. No. 3,996,410 (pretreatment of a nonconductive substrate with an alkali metal hydroxide) U.S. Pat. No. 3,578,484, (sulfonating of nonconductive substrate) and U.S. Pat. No. 3,130,067, (pretreatment with ionizing radiation).

However, none of the prior art coating compositions has provided the unique combination of properties which are obtained when the polymeric coatings of this invention are employed. The prior art coatings applied only monomeric substances to the nonconductive surface and these substances contributed to an overall loss of film properties. In addition, they did not work well under low humidity conditions and these monomeric compositions tended to be ineffective when over-coated with more than about 1.0 mils of a thermoplastic coating.

Accordingly, it is an object of this invention to prepare new compositions of matter which will render otherwise nonconductive glass, plastic and wooden materials sufficiently conductive to allow electrostatic spraying.

It is another object of this invention to develop a new electrostatic spraying process which will improve the electrostatic sprayability of otherwise nonconductive wooden and plastic articles.

It is an object of this invention to develop new electrostatic spray coating compositions which are based upon polymeric rather than monomeric materials.

It is yet another object of this invention to prepare polymeric materials which will improve the electrostatic sprayability of wooden, glass and plastic articles.

These and other objectives are obtained by preparing the compositions of the instant invention.

SUMMARY OF INVENTION

The instant invention involves the discovery that certain electrically conductive, polymeric coatings applied to wood, glass or plastic, nonconductive surfaces will allow the electrostatic spraying of these otherwise nonconductive substrata. The polymeric materials useful in this invention are disolved in methanol or another nonaqueous solvent and applied to the nonconductive surface to be coated. The polymers useful herein should exhibit a charge density, as defined hereafter, of at least about 2.25. In the preferred instance, these polymeric materials are based upon polydialkyldiallyl ammonium halide homopolmers or copolymers. Following application of the conductive coating and the removal of any residual solvent, one, or more than one, top coating may be applied by electrostatic spraying.

DETAILED DESCRIPTION OF INVENTION

The process of this invention is particularly applicable to continuous or semi-continuous operations where nonconductive products are sprayed with a variety of base and topcoatings in an assembly line fashion. The process is applicable to nonconductive substrata such as glass panels, plastic coverings, wood and other materials including laminates which are not normally considered to be electrically conductive. The process is also applicable to previously-coated substrata which are not sufficiently conductive so as to allow electrostatic spray coating. For example, where the surface to be treated is wood, it may be necessary in certain instances to apply a preliminary pre-treatment to fix the grain of the wood or otherwise to seal the base wood coating. The coatings disclosed herein may be applied to such a precoated base.

The conductive coatings of the instant invention may be applied to the substrate by any conventional application technique. Preferably, however, they are applied by spray coating, although dip coating or flow coating techniques may also be employed. In general, the coatings are applied to a thickness of about one to four mils wet. It is preferred that very low film thicknesses be applied since only a minimum amount of material is necessary. Generally, the percentage of the polymer in the coating is in the range of about 0.5% to 10% based on the total coating weight including solvent. Higher amounts, of course, may be employed without adverse impact. However, generally no more than about 4% by weight of the material is necessary to obtain optimum conductivity so as to permit electrostatic over-coating.

After the nonconductive substrate is sprayed or otherwise coated with the conductive coating of this invention, the solvents for the coating are evaporated in a flash zone. When solvents such as methanol are used as the solvent for the coating composition, a five minute room-temperature flash is usually sufficient. However, with slower solvents, longer flash periods at elevated temperatures in flash ovens may be employed.

The electrostatic spraying step is carried out using steps well known in the art and, accordingly, need not be described in detail here. Typically the overall process is designed to provide a smooth, consistent, electrostatically sprayed coating of a thickness of about 0.1 to 25 mils, typically 0.5 to 3 mils.

The electrostatic spraying step may occur immediately after the application of the conductive coating or the conductive coating may be overcoated with dyes, pigmented low solids coatings, wash coats, low solids coatings of nitrocellulose, wiping or other types of stains, or other materials before a final electrostatically sprayed coating is applied. In most cases, coatings of up to about 2–3 mils of dry film thickness may be applied over the base conductive coating described herein. If a coating of greater than this thickness is applied, the conductive coating may tend to lose its electrostatic over-spraying properties. Also if conductive coatings are overcoated with thermosetting coating compositions, they will quite rapidly lose their electrostatic spraying properties.

Electrostatic spraying equipment is generally arranged so that the conveyor line is grounded. This ensures that the electrostatically sprayed coatings projected by the spray station will be attracted to the individual articles on the spraying line in a very efficient manner resulting in a uniform and virtually flawless coating on each article. In general, a metallic attachment mechanism is applied to the article to be coated, and this is in turn attached to an electrical source. In most instances, more than one application point is utilized so that a uniformly dispersed electrically charged field may be established across the entire article to be coated. The article is then charged so that it will attract the oppositely charged coating particles coming from the electrostatic spray coating gun.

In U.S. Pat. No. 3,996,410, the details of conventional electrostatic spray-coating techniques are described. See, also U.S. Pat. No. 3,399,075 and U.S. Pat. No. 3,348,965.

Once the articles have been given the preparatory treatment with a conductive polymeric coating of this invention and then spray coated as set out above, additional steps such as drying, baking or the application of additional coatings or finishes and the like can be carried out in a conventional manner.

The conductive polymers which are useful in the instant invention are generally polymers which contain amine groups, which may be salted to form a quaternary ammonium salt. The amine groups can be quaternized with virtually any organic acid including formic, acetic, propionic, butyric, as well as longer chained fatty acids and the aromatic organic acids such as particularly benzoic acid. Among the inorganic acids which may be utilized to quaternize the amines are hydrochloric, sulfuric and phosphoric acids. Materials such as dialkyl sulfates and alkyl chlorides may also be employed to quaternize the amines with the most preferred being dimethyl sulfate and methyl chloride.

It is not necessary to quaternize each amine group in the finished polymer. Only enough of the amine groups on the finished polymer need be quaternized so as to provide a charge density as defined hereafter of at least about 2.25. An illustration by which charge density is calculated is shown below. In general, charge density means the number of charge units per amine nitrogen equivalent of the polymer.

For a 75/25 Dimethyldiallylamonium chloride (DMDAAC)/N,N-dimethylacrylamide (NNDMA) copolymer:

75 g/161.5 g/mole=0.4644 mole DMDAAC 25 g/99 g/mole−0.2525 mole NNDMA 0.4644+0.2525−0.7169 mole total 0.4644/0.7169=0.6478=mole fraction of DMDAAC 0.2525/0.7169=0.3522−mole fraction of NNDMA For a 100 mole polymer segment:

64.78 mole *DMDAAC*/segment × 161.5 g/mole = 10461.97 g/segment 35.22 mole *NNDMA*/segment × 99 g/mole = 3486.78 g/segment $$\frac{(10461.97 + 3486.78)\ \text{g/segment}}{64.78\ \text{charge units/segment}} = 215.32\ \text{g/charge unit}$$

$$\frac{1\ \text{charge unit}}{215.32\ \text{g}} \times \frac{1000\ \text{g}}{1\ \text{kg}} = 4.64\ \text{charge units/kg}$$

The resulting conductive polymers are then solubilized in a nonaqueous solvent for the polymer. In the alternative the polymeric material may be dispersed in a nonaqueous dispersion using conventional dispersion techniques. The solvents which are preferred include the low boiling alcohols such as methanol, ethanol and isopropanol as well as the low boiling ketones, low boiling naphthas and other petroleum fractions having boiling point ranges of no greater than about 125° C.

The monomers which may be used to prepare the conductive polymeric coatings of the instant invention are unsaturated amines including allyl, vinyl and acrylate based amines such as the dialkylaminoalkyl (meth-)acrylates, dialkyldiallylamines, imidazoline and the like. Preferably the pendant alkyl groups should be in the $C_1$–$C_6$ category. Specific examples of such materials include dimethylaminoethyl methacrylate, and dimethyldiallyl amine and virtually any other monomeric amine which can provide a polymer having pendant groups capable of being quaternized. Each of the amine monomers which is utilized must be capable of free radical or ionic polymerization and must contain no groups which interfere with this polymerization or with the quaternization reaction.

The above monomers may be copolymerized with another monomer which is copolymerizable therewith. In general, the only requirement of the copolymerizable monomer is that the monomer must be polymerizable through ionic or free radical type catalysts and must contain no groups which interfere with the formation of quaternary salts or with the free radical polymerization process (among the monomers which are excluded would be acid type monomers such as acrylic type acids). Preferred among these copolymerizable monomers are diacetone acrylamide, methyl methacrylate, hydroxyethylacrylate, ethylacrylate and the like.

Homopolymerization and copolymerization of the conductive monomers referred to above may be carried out by conventional polymerization techniques well known in the art. In general, the polymerization is carried out utilizing free-radical generating catalyst such as azobisisobutyronitrile, t-butyl hydroperoxide and other similar free radical generating catalysts which are well known.

The preferred polymers herein are the dimethyldiallyl ammonium chloride homopolymers and their copolymers with the above described monomers. The preparation of these homopolmers is described in U.S. Pat. No. 3,288,770. Also useful herein are cellulosic based polymers which contain amine nitrogen groups in the cellulosic polymer chain, which groups are capable of forming a quarternary salt as specified above.

The viscosity of the electrostatic polymeric coating is reduced to the solids content specified above and applied as a coating to render the base nonconductive substrate electrostatically sprayable.

EXAMPLES

In the following examples wrap and coverage tests on various conductive coatings were carried out utilizing the following procedure. Test pieces of $1\frac{5}{8}$ inch diameter fir handrail were cut to 18 inch lengths. Each test piece was coated by dipping in the test coating which had been reduced to the same percent nonvolatile. Each dipped piece was provided with four staples, one on the top, two on the upper sides, and one on the bottom. Conductivity or sprayability readings were taken using a Ransburg 8333-00 sprayability meter. Conductivity readings were taken at regular time intervals after the coating was applied or just prior to electrostatic spraying. After the base coat was applied, one or more intermediary coats of clear, nonconductive lacquer sealers of conventional composition (50% nitrocelulose, 50% oil-free alkyl) were applied by air atomized spraying. The top coat used for evaluation was a high hiding, black lacquer which was applied by electrostatic spraying.

EXAMPLE 1

A 40% non-volatile aqueous solution of polydimethyl dially ammonium chloride was dehydrated by batch oven drying. The resulting solid product was then dissolved in anhydrous methanol and reduced to about 4% solids in methanol. This product was applied to wooden fir handrails as described above.

EXAMPLE 2

A standard, non-polymeric, electrostatic spraying base coat was prepared by mixing 100 parts of ECC 549, a dialkyldimethyl ammonium chloride, monomeric material available from the Electrocote Company with 900 parts of methanol. This solution, 4% solids by weight in methanol, was applied as described above.

Examples 1 and 2 were compared to a foil covered fir handrail with the results shown in Table 1.

TABLE I

| | Sprayability Reading after Prep | Sprayability Reading after Sealer | Transfer Efficiency of Top Coat[1] | Cover Percentage[2] | Degree Efficiency Relative Foil |
|---|---|---|---|---|---|
| Example 1 | 86.7 | 85.9 | 41.5 | 93 | 93.5 |
| Example 2 | 80.1 | 79.1 | 26.1 | 59 | 56.9 |
| Foil Covered | 165+ | 165+ | 44.4 | 95 | 100 |

[1]This test measures the percentage of the paint that is sprayed which actually ends up on the part being coated.
[2]This test measures surface area of the part being coated that is in actuality coated with the electrostatic coating.

As can be seen from the above table, the polymeric material prepared in Example 1 provided far superior coating efficiency as compared to the prior art, standard, monomeric spray-on material.

EXAMPLES 3–14

In the Examples shown in Table II, various conductive polymers were fully quaternized as indicated and tested for conductivity. The Column headed charge density is the "charge density" as calculated using the formula shown in the specification on page 7. Sprayability was determined using the Ransburg sprayability meter described above. If the conductivity of the finished polymer, after drying, was greater than 90, the material was determined to be conductive using the Ransburg standards. If the conductivity measurement was less than 90 the material was deemed to be non-conductive.

TABLE II

| Example No. | Polymeric Material | Sprayability | Calculated Charge Density |
|---|---|---|---|
| 3. | Polydimethyldially ammonium chloride (Poly DMDACC) (Merquat 100 - Merck & Co., Inc.; Agefloc WT-40 - CPS Chemical Company, Inc.) | yes | 6.19 |
| 4. | Poly DMDACC (dry) (3842-152 - National Starch) | yes | 6.19 |
| 5. | 75/25 copolymer of DMDAAC and N,N—dimethylacrylamide | yes | 4.64 |
| 6. | Homopolymer of dimethylaminoethyl methacrylate quaternized with dimethyl sulfate | yes | 3.53 |
| 7. | Homopolymer of dimethylaminoethyl methacrylate quaternized with methyl chloride | yes | 4.81 |
| 8. | Homopolymer of dimethyl diallyl ammonium acetate | yes | 5.40 |
| 9. | Homopolymer of dimethyl diallyl ammonium benzoate | yes | 4.05 |
| 10. | Polyimidazoline quaternized with dimethyl sulfate | yes | 5.10 |
| 11. | Poly (dimethylamine-co-epichlorohydrin) quaternized with methyl chloride | yes | 7.27 |
| 12. | 35% DMDACC/58.5% 2-hydroxylethylacrylate/6.5% methyl methacrylate polymer | borderline | 2.17 |
| 13. | 35% dimethylaminoethylmethacrylate/35% methyl methacrylate/30% ethyl acrylate - quaternized with dimethyl sulfate | no | 1.24 |

As can seen from above, except for Example 13, each of the polymers prepared possessed the minimum necessary sprayability such that the polymers can be applied to a nonconductive coating and will allow electrostatic over spraying of a coating.

We claim:

1. A process for coating a wooden substrate comprising (a) applying to the substrate a nonaqueous, surfactant-free coating of a conductive polymeric material having a charge density of greater than about 2; (b) drying the conductive coating; and (c) applying a topcoat over the conductive coating by electrostatic spraying.

2. The process of claim 1 wherein the conductive polymeric material has a charge density of greater than about 2.25.

3. The process of claims 1 or 2 wherein the polymeric material is a homopolymer or copolymer of dialkyldiallylammonium chloride.

4. The process of claims 1 or 2 wherein the polymeric material is a cellulosic based polymer having amine nitrogen atoms present in the polymer backbone.

5. The process of claim 3 wherein the copolymer contains at least about 30% of a dialkyldiallylammonium chloride.

6. A process for coating a nonconductive wood substrate which comprises: (a) apply to the substrate a coating of a nonaqueous, surfactant-free solvent solution or dispersion of a conductive polymeric material having a charge density of at least about 2.25; (b) removing substantially all of the solvent from the conductive coating; and (c) applying a topcoat over the coating by electrostatic spraying wherein the polymeric material is a homopolymer or copolymer of dialkyldiallyammonium chloride.

7. The process of claim 6 wherein the copolymer contains at least about 30% of a dialkyldiallylammonium chloride.

8. The process of claims 1 2, 6 or 7 wherein the conductive polymer is a quaternized polymer wherein the quaternization agent is selected from the organic and inorganic acids and alkyl sulfates and chlorides.

9. The process of claim 8 wherein the quaternization agent is hydrochloric acid.

* * * * *